US007522067B2

(12) United States Patent
Jensen et al.

(10) Patent No.: US 7,522,067 B2
(45) Date of Patent: Apr. 21, 2009

(54) VARIABLE DISPLAY

(75) Inventors: Thomas Jensen, Boise, ID (US); Casimer E. Lawler, Jr., Boise, ID (US)

(73) Assignee: PakSense, Inc., Boise, ID (US)

( * ) Notice: Subject to any disclaimer, the term of this patent is extended or adjusted under 35 U.S.C. 154(b) by 175 days.

(21) Appl. No.: 11/402,660

(22) Filed: Apr. 11, 2006

(65) Prior Publication Data

US 2006/0227002 A1 Oct. 12, 2006

Related U.S. Application Data

(60) Provisional application No. 60/670,508, filed on Apr. 11, 2005.

(51) Int. Cl.
*G08B 3/00* (2006.01)

(52) U.S. Cl. ..... 340/691.1; 340/691.6; 340/691.8; 347/101

(58) Field of Classification Search ..... 340/691.1
See application file for complete search history.

(56) References Cited

U.S. PATENT DOCUMENTS 4,603,326 A * 7/1986 Freed ..... 340/572.8
5,442,669 A * 8/1995 Medin ..... 377/20
6,337,836 B1 * 1/2002 Eidelson ..... 368/10
6,557,760 B2 * 5/2003 Goodwin, III ..... 235/383
6,664,887 B1 * 12/2003 Fuchs ..... 340/309.16
6,795,376 B2 * 9/2004 Quine ..... 368/10
2002/0186131 A1 * 12/2002 Fettis ..... 340/568.1
2004/0160501 A1 * 8/2004 Yokouchi et al. ..... 347/101

* cited by examiner

*Primary Examiner*—Jeffery Hofsass
*Assistant Examiner*—Kerri L McNally
(74) *Attorney, Agent, or Firm*—Brooks, Cameron & Huebsch, PLLC

(57) ABSTRACT

Embodiments of the present application relate generally to methods and apparatus for relating information in a form either machine-readable, human-readable, or some combination thereof. More particularly, although not exclusively, these embodiments are concerned with the display of information on a smart active label or smart packaging where low power and low cost are significant considerations. In some embodiments, display methods are based on electronic, electromechanical, electrochemical, and combinations thereof configured or manufactured using printing techniques, micro-electromechanical system (MEMS) techniques, or combinations thereof to achieve high reliability, low cost, and low activation energies. The embodiments described above can provide an accurate and low-cost apparatus and method for relating the information obtained by smart active labels and smart packages.

11 Claims, 6 Drawing Sheets

VARIABLE DISPLAY

RELATED APPLICATION

This application claims priority to U.S. Provisional Patent Application No. 60/670,508, filed Apr. 11, 2005 and entitled ELECTRONICALLY ACTIVATED DISPLAY APPARATUS AND METHOD, the disclosure of which is incorporated herein by reference in its entirety.

BACKGROUND

Embodiments of the present application relate generally to methods and apparatus for electronic and electrically activated displays. More particularly, although not exclusively, these embodiments are concerned with small, low cost, low power electronic and electrically activated displays for use in product and packaging labels.

It is generally desirable in the art of making smart labels and smart packaging products to be able to relate information obtained by the smart label sensor in a low energy and low cost manner. Such methods of relating information can be used in quality control and quality assurance activities to improve product quality, safety, and security. Information may be related in either a machine-readable, human-readable, or a combination of both human and machine-readable forms.

To accomplish such information transfer, it is known in the art that certain industry standard embedded radio frequency (RF) transmitters or static bar codes may be used to relate machine-readable information. Static printed labels and enzymatic tags may be used to relate human-readable information. Liquid crystal displays (LCD) or light emitting diode (LED) displays may be used to relate both machine and human-readable information.

When considering the update in information made available by the smart label or smart package, a static bar code or static printed message is not useful. When considering the limited energy available to a smart label or package, industry standard RF transmitters, LCD, and LED displays are not practical for extended use. Passive RF transmitters may be used in limited application without additional energy requirements, however, better reliability is obtained with active, or battery assisted, RF transmitters. Industry standard LCD options are further constrained by their useful operating temperature range. Enzymatic and similar displays presently provide only a general indication of an event without variations or details.

Additionally, when considering the cost of goods required to build such displays into smart labels and smart packages, even at the smallest levels of integration (deep sub-micron), using fully custom Application Specific ICs (ASICs), the cost of goods may be too high to be applicable in a typical case-ready packaging situation. Cost sensitivities drive the need for lower-cost and lower-power methods for relating information for smart label and smart packaging devices.

SUMMARY

The architecture and fabrication methods of the present application provide lower-cost signal display and information transfer options through combinations of chemical, mechanical, and electronic systems.

It is understood that circuit elements such as transistors, resistors, capacitors, LEDs, and high grade conductors can be fabricated directly upon polyethyleneterephthalate (PET) substrates using ink-jet printing methods. It is also understood that silicon may be etched to make small mechanical parts and machines, much the way integrated circuits are manufactured. The systems and methods described herein apply these methods, in combination with the use of silicon-based circuits, to achieve low-cost and low power display and information transfer systems.

In one embodiment, a variable display system for a perishable product comprises an environmental sensor configured to sense one or more environmental conditions of the perishable product, a controller in communication with the environmental sensor, and a variable display element in communication with the controller via a display driver. The variable display element comprises a reservoir containing ink or a reactive agent. In addition, the controller is configured to modify the appearance of the variable display element by transmitting an electronic control signal to the variable display element in response to a selected change in the environmental conditions of the perishable product, as sensed by the environmental sensor.

In another embodiment, a variable display system for a perishable product comprises an environmental sensor configured to sense one or more environmental conditions of the perishable product, a controller in communication with the environmental sensor, and a variable display element in communication with the controller via a display driver. The controller is configured to modify the appearance of the variable display element by transmitting an electronic control signal to the variable display element in response to a selected change in the environmental conditions of the perishable product, as sensed by the environmental sensor. In addition, the variable display element comprises an electrochemical material configured to change optical characteristics in response to the electronic control signal.

In another embodiment, a variable display system for a perishable product comprises an environmental sensor configured to sense one or more environmental conditions of the perishable product, a controller in communication with the environmental sensor, and a variable display element in communication with the controller via a display driver. The controller is configured to modify the appearance of the variable display element by transmitting an electronic control signal to the variable display element in response to a selected change in the environmental conditions of the perishable product, as sensed by the environmental sensor. In addition, the variable display element comprises one or more electromechanical components configured to move in response to the electronic control signal.

These and other embodiments of the present application will be discussed more fully in the detailed description. The features, functions, and advantages can be achieved independently in various embodiments of the present application, or may be combined in yet other embodiments.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

Figure 1:
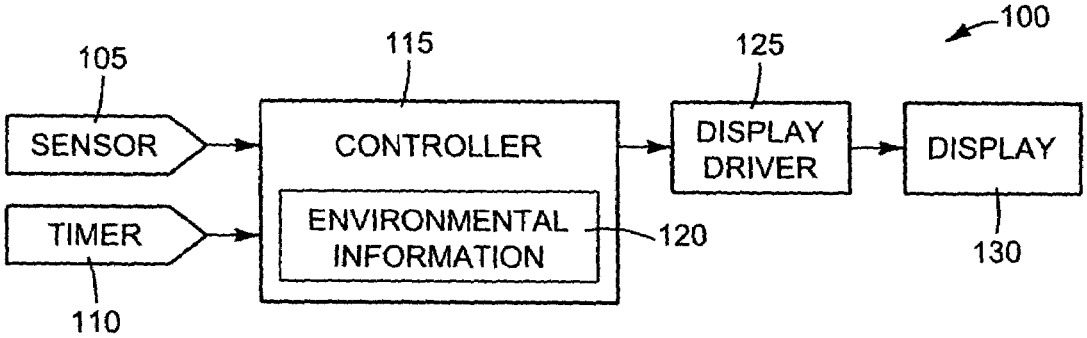
FIG. 1 is a block diagram of one exemplary embodiment of a display driver system.

FIG. 1 shows a basic schematic configuration of one exemplary embodiment of a display driver system 100. In the illustrated embodiment, the system 100 comprises at least one sensor 105 and timer 110 in communication with a controller 115, such as an analog controller circuit or a programmable logic device (PLD) controller. As illustrated, the controller 115 includes environmental information 120 regarding one or more environmentally-sensitive products, such as perishable products (e.g., meat, poultry, seafood, dairy products, cosmetics, chemicals), temperature-sensitive devices, components or structures, etc. The controller 115 is in communication with a display driver 125, which in turn communicates with a display 130, such as the date display 200 shown in FIG. 2 or the variable bar code display 300 shown in FIGS. 3A and 3B.

In operation, the system 100 controls the display 130 based on sensor input to the controller 115. One or more sensors 105 feed information to the controller 115, which makes a determination of whether or not the display 130 needs to be changed and by how much. Based on this assessment, the controller 115 signals the display driver 125 to make a change to the display 130. This display driver 125 may be integrated into the controller 115 or a separate unit. The display 130 and associated methods described below may be used in a variety of forms, including graphical display elements for such tasks as a freshness or doneness indicator.

The display 130 may comprise part of a smart active label (SAL) or intelligent package (IP) with an incorporated sensor, and the SAL or IP controlling the display 130. A "Use by" date can be more accurately posted by allowing the SAL or IP to update the date based on freshness information and environmental conditions of the related product. In some embodiments, the UPC changes after spoilage to identify a different product, such as a spoiled product.

Figure 2:
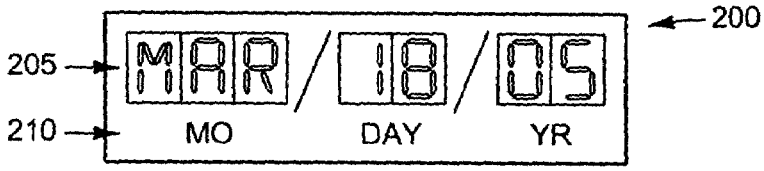
FIG. 2 is a schematic diagram of one embodiment of a variable "Use By" or "Sell by:" packaging date stamp.
Figure 3A:
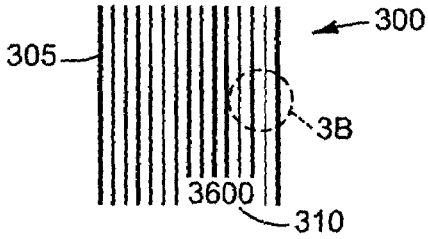
FIG. 3 is a schematic diagram of one embodiment of a variable bar code display.
Figure 3B:
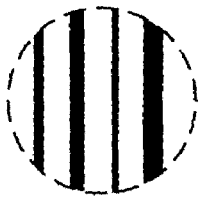
Figure 4A:
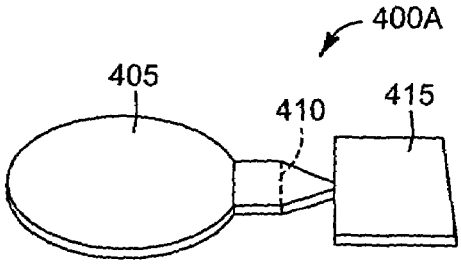
FIG. 4 illustrates various exemplary embodiments of bistable, low power, ink-based display elements.
Figure 4B:
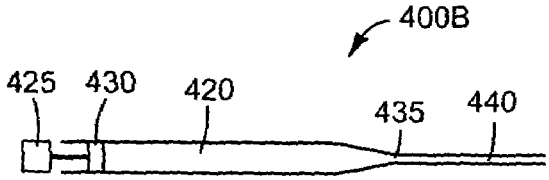
Figure 4C:
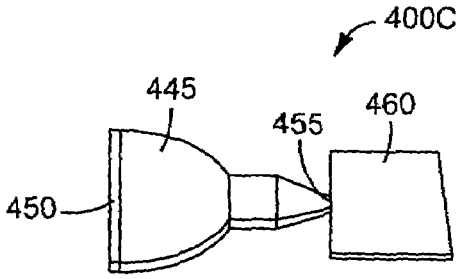
Figure 4D:
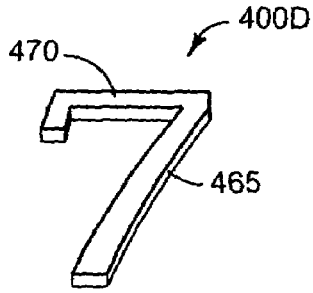
Figure 4E:
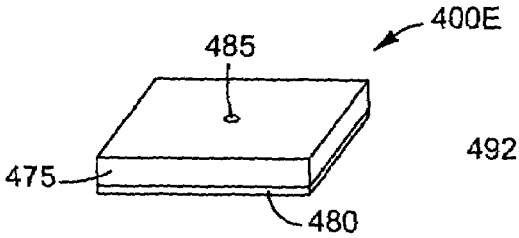
Figure 4F:
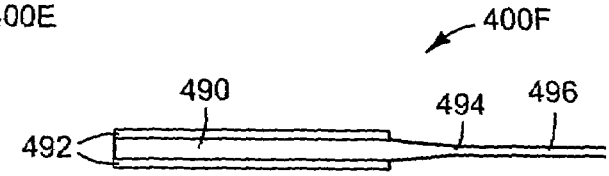
Figure 5A:
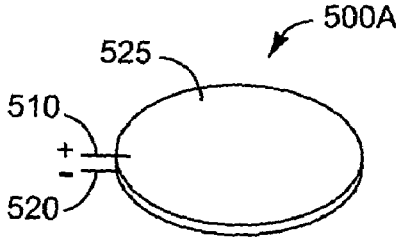
FIG. 5 illustrates various exemplary embodiments of electrochemical displays.
Figure 5B:
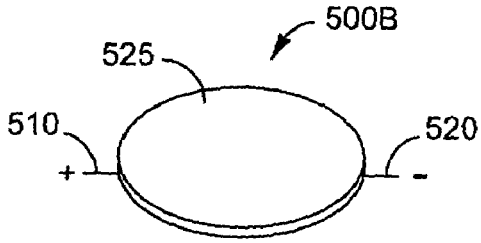
Figure 5C:
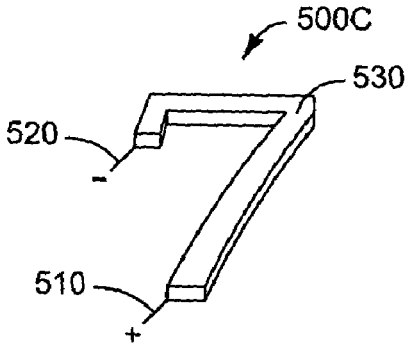
Figure 5D:
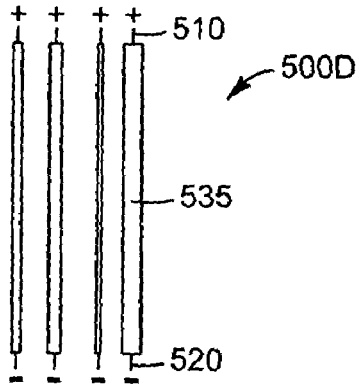
Figure 5E:
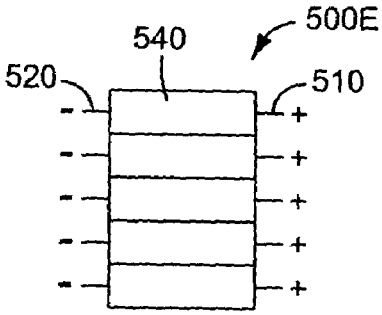
Figure 5F:
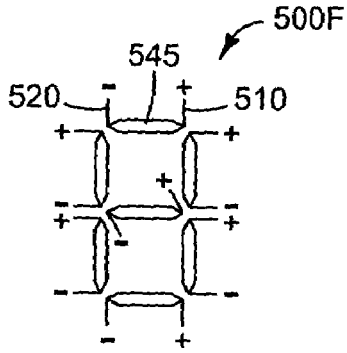

FIG. 2 illustrates a portion of one exemplary embodiment of an integrated UPC and "Use By" or "Sell By" date display 200 that updates to match measured freshness values of a product. The date display 200 comprises one or more variable display elements 205, such as alphanumeric characters representing a display date, which can be modified based on a freshness assessment. The date display 200 further comprises one or more static display elements 210, such as a printed legend located below the display date. In the illustrated embodiment, the variable display elements 205 comprise segmented display characters, whereas in other embodiments, the variable display elements 205 may comprise dot matrix displays, character overlay displays, etc.

In some embodiments, the date display 200 comprises a variable date stamp, which can be used to relate "Use By" or "Sell-By" information on perishable products. The display 200 is preferably low power and bi-stable, such as NTERA nanotubes or e-Ink electrostatic colored balls. The display 200 may also comprise mechanical MEMS-based sliding or flipping displays. Given a variety of uses, the display 200 may also comprise a liquid crystal display (LCD), light emitting diode (LED), or electroluminescence (EL) display. Low power EL inks make it possible to print the display 200 directly on a plastic substrate for mass produced labels.

FIG. 3 illustrates one exemplary embodiment of a variable bar code display 300. In the illustrated embodiment, the bar code display 300 comprises a plurality of variable bar code characters 305, as well as a plurality of optional alphanumeric characters 310. Both the bar code characters 305 and the alphanumeric characters 310 may be partially printed in ink and partially variable displays. The display 300 may comprise electronically actuated micro-inkjet, or electronic display using LCD, LED, EL, MEMS, or bi-stable display material.

In some embodiments, each bar code character 305 is represented by one or more adjacent vertical pixels, which are long and narrow, e.g., the width of a single bar code element. The display of adjacent pixels can be selectively controlled to adjust the width, and hence the numerical value, associated with a given bar code character 305. Therefore, as described above, a sensor 105, controller 115, and display driver 125 can be used to alter the UPC code represented by the variable bar code display 300 when spoilage or another selected condition occurs. In this scenario, a manufacturer could secure additional UPC codes to assign to products in a modified condition, which could help the manufacturer in monitoring and tracking of returned goods.

FIG. 4 illustrates various embodiments of bi-stable, low power, ink-based display elements 400. In these embodiments, an electronically-released ink or dye is used for display purposes. The ink-based display elements 400 may comprise part of a smart active label (SAL) or intelligent package (IP) with an incorporated sensor, and the SAL or IP controlling the display. A change in the portion of a label or identification area on the SAL or IP caused by the activation of an ink-based display element 400 could indicate a change in the product as determined by the sensors and algorithms of the SAL or IP. An area on the label or package may be filled with a color, or a different alphanumeric character may appear in a code, or the UPC label may change to a different number. This change in color or state could result from material released from a reservoir by any of a variety of means including fuse-like bursting of a containment wall, electromechanical linkages, and single inkjet-like nozzles.

In general, the ink-based display elements 400 shown in FIG. 4 have an ink reservoir and a projector or mover for the ink. These display elements 400 may also include a shaped space or particular wicking material to enhance the speed or shape of the display. The ink projector-mover may take a variety of forms, including a small ink jet nozzle, which may be similar in the form of standard industry printer nozzles, or based on a piezo-electric pump.

For example, display element 400A comprises an ink reservoir 405, a display area 415 comprising a wicking material or capillary space, and a flash barrier 410, which initially separates the ink reservoir 405 from the display area 415. While the display area 415 has a generic rectangular shape in the illustrated embodiment, those of ordinary skill in the art will understand that the display area 415 may have any of a wide variety of desired shapes and sizes. For example, the display area 415 may comprise one or more segments in a segmented display, one or more dots in a dot matrix display, one or more pixels in a variable bar code display, etc. The barrier 410 may comprise a small resistive material that is destroyed when a sufficient electrical current passes through it, such as a fuse. In operation, when the barrier 410 is removed or destroyed, the ink in the reservoir 405 moves into the display area 415 through wicking action or capillary motion.

Display element 400B comprises an ink reservoir 420, a MEMS based linear actuator 425 and plunger 430 located on one side of the reservoir 420, a nozzle 435 located on the other side of the reservoir 420, and an optional display area 440 comprising a wicking material or capillary space located adjacent to the nozzle 435. The optional display area 440 may have any desired shape and size. Upon activation, the MEMS based linear actuator 425 moves the plunger 430 to squeeze the ink out of the reservoir 420 through the nozzle 435 and into the optional display area 440 (if present).

Display element 400C comprises an ink reservoir 445, a piezo film 450 located on one side of the reservoir 445, a nozzle 455 located on the other side of the reservoir 445, and an optional display area 460 comprising a wicking material or capillary space located adjacent to the nozzle 455. In operation, the piezo film 450 acts as a pump that, upon activation, squeezes the ink out of the reservoir 445 through the nozzle 455 and into the optional display area 460 (if present).

Display element 400D comprises an ink reservoir 465 having a desired shape and size, as well as an upper surface 470 comprising a flash barrier or other suitable material. In operation, the upper surface 470 can be destroyed or disrupted by an electrical pulse, thereby revealing the ink stored in the reservoir 465. In other embodiments, the top surface 470 may comprise an enzymatic material to create a "timed" or organic time-temperature integration display.

Display element 400E comprises an ink reservoir 475 having a desired shape and size, a piezo oscillator 480 located on a lower surface of the reservoir 475, and one or more nozzles 485 located on an upper surface of the reservoir 475. In operation, the piezo oscillator 480 acts as a pump that squeezes the ink out of the reservoir 475 through the one or more nozzles 485 upon activation.

Display element 400F comprises an ink reservoir 490, a piezo film 492 located on an upper and lower surface of the reservoir 490, a nozzle 494 located on one side of the reservoir 490, and an optional display area 496 comprising a wicking material or capillary space located adjacent to the nozzle 494. In operation, the piezo film 450 acts as a pump that, upon activation, squeezes the ink out of the reservoir 445 through the nozzle 455 and into the optional display area 496 (if present).

As an alternative to ink, the display elements 400 could use a reactive agent in their respective reservoirs to change the color of a wicking agent or a pre-printed area on the display or its surface. The display elements 400 can be driven by a system 100 like that shown in FIG. 1. Once activated, these display elements 400 would be one-time-use, and could not be altered or changed again. These display elements 400 may be activated as a fail-safe display method when the display or label power source nears the end of its operational life.

FIG. 5 illustrates various embodiments of electrochemical displays 500. These displays 500 may comprise part of a smart active label (SAL) or intelligent package (IP), with an incorporated sensor and the SAL or IP controlling the display. A change in the portion of a label or identification area on the SAL or IP caused by the activation of an electrochemical display 500 could indicate a change in the product as determined by the sensors and algorithms of the SAL or IP. An area on the label or package may change color, or a different alphanumeric character may appear in a code, or the UPC label may change to a different number. This change in color or state could result from electrically stimulating the electrochemical material.

In general, the electrochemical displays 500 shown in FIG. 5 comprise inks or other materials that change optical characteristics, such as color or transparency, when a voltage or current is applied to them. Preferably, these inks or other materials are bi-stable, similar to dithienylethene type compounds. These chemicals may be held in a reservoir or printed on a substrate. Each display 500 comprises one or more display elements in electrical communication with a positive electrode 510 and a negative electrode 520, which can be used to apply an electrical voltage or current to control the appearance of the respective display elements.

As illustrated, the electrochemical displays 500 may comprise a wide variety of suitable shapes and sizes. For example, displays 500A and 500B comprise generic dot or pixel display elements 525, display 500C comprises an alphanumeric display element 530, display 500D comprises a plurality of vertical pixels 535 that can be used in connection with a variable bar code display 300, display 500E comprises a plurality of adjacent rectangular display elements 540 to form a variable bar graph display, and display 500F comprises a plurality of segment display elements 545 to form a segmented display. Other suitable shapes and sizes will become apparent to those of ordinary skill in the art.

In operation, the electrodes 510, 520 can be activated and controlled with a system 100 similar to that shown in FIG. 1. In addition, the electrochemical displays 500 shown in FIG. 5 can be colorized to enhance readability. Displays for smart active labels and packaging are preferably low-power and bi-stable.

FIGS. 6-8 illustrate various embodiments of MEMS based electromechanical displays, in which one or more very small mechanical mechanisms are used to physically move contrasting pixels or areas in and out of view, or move a cover to allow the contrasting pixel elements to be seen or hidden from view. These displays provide information transfer for SAL and IP as well.

In operation, the appearance of a MEMS based electromechanical display is controlled by using a MEMS actuator (e.g., a rotary or linear actuator) to uncover or cover a contrasting colored area. For example, if the background is a dark color, the contrasting color may be white or blaze orange. Similarly, if the background color is a light color, the contrasting color may be black. The cover color should match that of the background color so as not to hide the contrasting colored component of the display. A MEMS based electromechanical display may be a one-time or multi-use display. A system 100 as in FIG. 1 may be used to actuate such a display based on a predetermined condition.

Figure 6A:
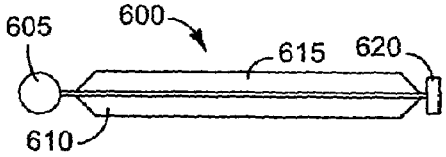
FIGS. 6-8 illustrate various exemplary embodiments of MEMS based display elements.
Figure 6B:
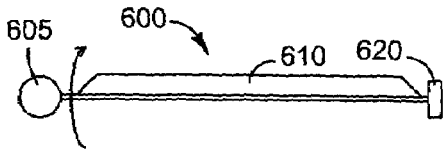

FIGS. 6A and 6B illustrate one exemplary embodiment of a MEMS based rotary display element 600. In the illustrated embodiment, the display element 600 comprises a MEMS rotary actuator 605, a rotating-flipping piece 610, a fixed piece 615, and a rotation constraint 620 holding the rotating-flipping piece 610 in position with the rotary actuator 605. In some embodiments, the open face of the rotating-flipping piece 610 is the same color as the contrasting colored area, while the backside of the rotating-flipping piece 610 is the same as the background color.

Figure 7A:
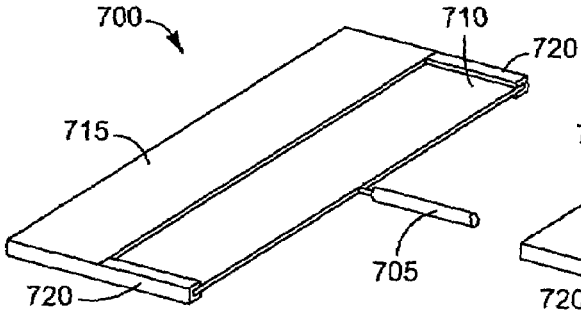
Figure 7B:
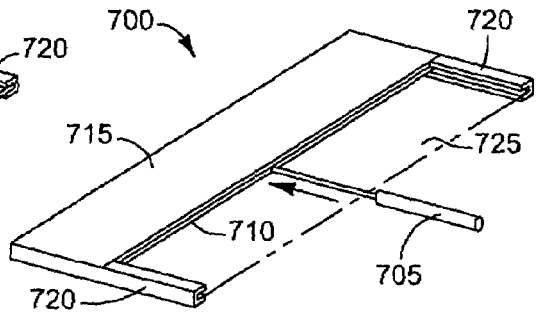

FIGS. 7A and 7B illustrate one exemplary embodiment of a MEMS based sliding display element 700. In the illustrated embodiment, the sliding display element 700 comprises a MEMS linear actuator 705, a sliding piece 710, a fixed piece 715, and a pair of slide guides 720. In some embodiments, a contrasting-colored area 725 is covered or uncovered by the background-colored sliding piece 710 when the linear actuator 705 is activated.

Figure 7C:
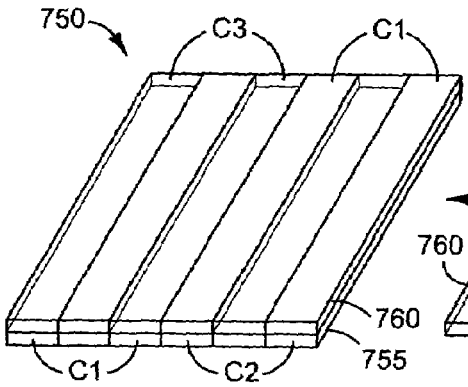
Figure 7D:
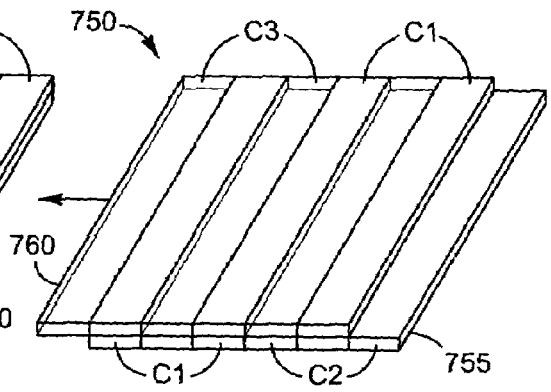
Figure 7E:
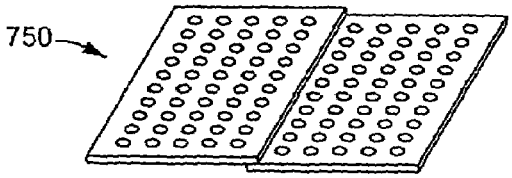

FIGS. 7C and 7D depict another embodiment of a sliding display element 750. In this embodiment, a base or backing piece 755 is marked with pattern of contrasting color in the same way as a top, sliding piece 760 is patterned with a background color. The pattern of the backing piece 755 varies between the background color, C1, and the contrasting color, C2. The pattern of the sliding piece 760 varies between the background color, C1, and a clear space, C3, that allows the color of the backing piece 755 to show through. This clear space may also comprise holes cut into a pattern, as shown in FIG. 7E.

In some embodiments, the background-colored pattern on the sliding piece 760 is slightly larger than that of the backing piece 755 to ensure that the contrasting color, C2, is completely covered when the pieces are overlaid, as shown in FIG. 7C. Upon actuation, the sliding piece 760 is moved slightly allowing the contrasting color, C2, on the backing piece 755 to show through, as shown in FIG. 7D.

FIG. 8 depicts an additional embodiment of a MEMS based display element 800. In this embodiment, the display element 800 comprises a lower backing piece 805 and an upper sliding piece 810. In some embodiments, the bottom of the backing piece 805 is colored with a contrasting color, whereas in other embodiments, the backing piece 805 covers the contrasting color or image. In some embodiments, the top of the backing piece 805 is fabricated from a substrate comprising a clear polarized filter, or from a clear substrate with small, aligned elements such as micro-slats or filaments, or diffraction grating. The upper sliding piece 810 can be made of the same or similar substrate as the backing piece 805, without a bottom coloring or covering, so as to be substantially transparent. The micro-slats or filaments used are preferably colored the same as the display background color.

In operation, the sliding piece 810 may be slid horizontally over the backing piece 805, as described above in connection with FIG. 7. Alternatively, the backing piece 805 and the sliding piece 810 may be anchored at their centers by a spindle 815 allowing rotary movement. In this configuration, the backing piece 805 and the sliding piece 810 can be held at 90 degrees to each other to cover the image or contrasting color below, or rotated into alignment to display the image or contrasting color.

Figure 8A:
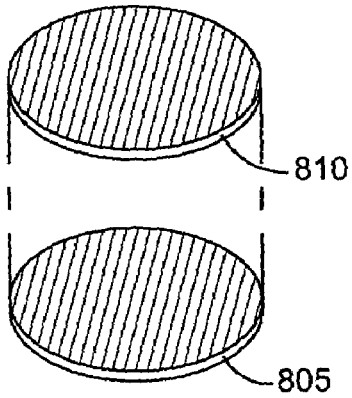
Figure 8B:
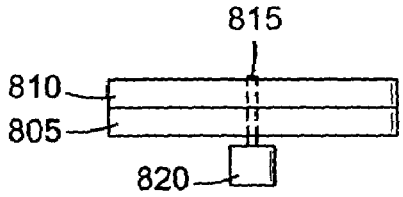
Figure 8C:
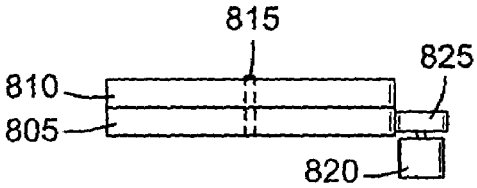
Figure 8D:
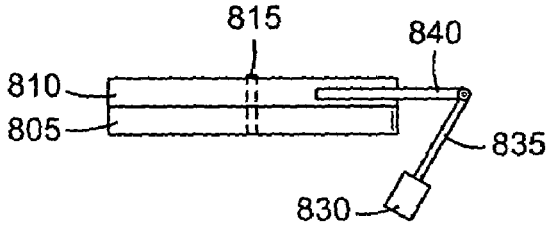
Figure 9A:
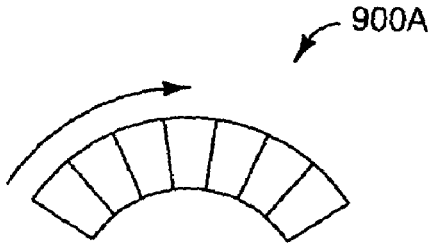
FIG. 9 is a schematic diagram of exemplary embodiments of graphical display elements using any of the disclosed display methods.
Figure 9B:
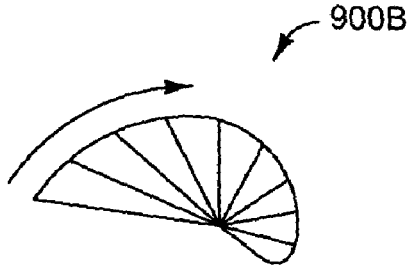
Figure 9C:
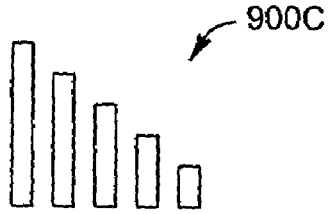
Figure 9D:
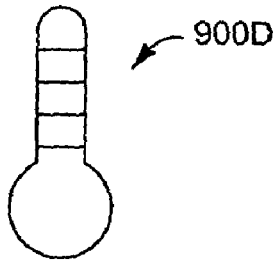
Figure 9E:
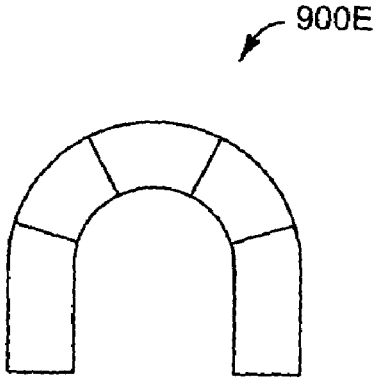
Figure 9F:
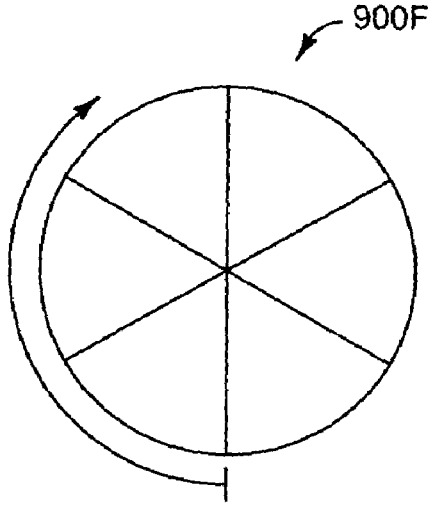

This rotation can be accomplished using a variety of suitable mechanisms, as shown in FIGS. 8B through 8D. For example, the spindle 815 can be rotated directly by a rotary MEMS actuator 820, as shown in FIG. 8B, thereby rotating either the lower backing piece 805 or the upper sliding piece 810. Alternatively, a rotary MEMS actuator 820 can rotate gearing or a friction wheel 825, as shown in FIG. 8C, to rotate either the lower backing piece 805 or the upper sliding piece 810. As another example, the rotation may be accomplished by a linear actuator 830 and linkage 835 in cooperation with a slider arm 840 attached to either the backing piece 805 or the sliding piece 810, as shown in FIG. 8D.

The display element principle illustrated in FIG. 8 may also be accomplished by covering an image or contrasting color with a LCD that reveals what is underneath it as the LCD elements are turned off. The LCD elements may be pigmented to match a background color. The LCD may comprise a standard form of aligned liquid crystal or an anamorphic form, in which the covered image or contrast color is not revealed until activation or deactivation.

The MEMS based electromechanical display elements depicted in FIGS. 6-8 can represent a wide variety of display elements, such as, for example, one or more segments in a segmented display, one or more dots in a dot matrix display, one or more vertical pixels in a variable bar code display, etc. In addition, these displays elements may be driven by a system 100 like that shown in FIG. 1. In operation, these display elements may be activated and re-activated to either show or hide the contrasting color, thereby changing the image and information displayed. These display configurations may also be used with backlighting to enhance readability.

FIG. 9 illustrates various embodiments of a smart active label 900 with graphical display options. These displays may be constructed using LCD, LED, EL, bi-stable display components such as e-ink, or with any of the display elements and associated methods described above. In some embodiments, the graphical displays shown in FIG. 9 may be colorized to enhance readability. Displays for smart active labels and packaging are preferably low-power and bi-stable.

Although this invention has been described in terms of certain preferred embodiments, other embodiments that are apparent to those of ordinary skill in the art, including embodiments that do not provide all of the features and advantages set forth herein, are also included within the scope of this invention. Accordingly, the scope of the present invention is defined only by reference to the appended claims and equivalents thereof.

What is claimed is:

1. A variable display system positioned on a label, tag, package, or packaging material comprising:

a controller;

an environmental sensor configured to sense one or more environmental conditions of an environmentally-sensitive product associated with the label, tag, package, or packaging material;

a display driver; and a bi-stable one-time-use variable display element in communication with the controller via the display driver, wherein the bi-stable one-time-use variable display element includes a reservoir containing ink or a reactive agent, wherein the controller is configured to modify the appearance of the label, tag, package, or packaging material by transmitting an electronic control signal from the display driver to the bi-stable one-time-use variable display element, and wherein the electronic control signal is generated in response to a selected change in the environmental conditions of the environmentally-sensitive product, as sensed by the environmental sensor.

2. The system of claim 1, wherein the environmentally-sensitive product comprises a perishable product.

3. The system of claim 1, wherein the bi-stable one-time-use variable display element further comprises upper barrier surface configured to be destroyed or disrupted by the electronic control signal, thereby revealing the ink or reactive agent stored in the reservoir.

4. The system of claim 1, wherein the bi-stable one-time-use variable display element further comprises a projector configured to move the ink or reactive agent from the reservoir to a desired display area when activated by the electronic control signal.

5. The system of claim 4, wherein the display area comprises a wicking material or capillary space.

6. The system of claim 5, wherein the projector comprises a wicking action or capillary motion created when a barrier located between the reservoir and the display area is removed or destroyed.

7. The system of claim 4, wherein the projector comprises an ink jet nozzle.

8. The system of claim 4, wherein the projector comprises a piezo-electric pump.

9. A variable display system comprising:

a label, tag, package, or packaging material that is configured to be moved with an environmentally sensitive product, including:

a controller;

an environmental sensor configured to sense one or more environmental conditions of an environmentally-sensitive product associated with the label, tag, package, or packaging material;

a display driver; and multiple variable display elements in communication with the controller via the display driver;

wherein each variable display element:

comprises a shaped space; and includes a reservoir containing ink or a reactive agent;

wherein the controller is configured to modify an appearance of the label, tag, package, or packaging material by transmitting an electronic control signal from the display driver to one or more of the multiple variable display elements;

wherein the electronic control signal is generated in response to a selected change in one or more of the environmental conditions of the environmentally-sensitive product, as sensed by the environmental sensor;

wherein the electronic control signal selects one or more of the variable display elements and causes the ink or reactive agent to enter the shaped spaces of the selected variable display elements to modify the appearance of the label, tag, package, or packaging material; and wherein the shaped spaces of the selected variable display elements are oriented with respect to each other on the label, tag, package, or packaging material to convey information regarding the environmentally-sensitive product.

10. A variable display system positioned on a label, tag, package, or packaging material that is configured to be moved with an environmentally sensitive product, comprising:

a controller;

an environmental sensor configured to sense one or more environmental conditions of the environmentally-sensitive product associated with the label, tag, package, or packaging material;

a display driver; and a display including multiple variable display elements, each element in communication with the controller via the display driver, wherein each variable display element includes a reservoir containing ink or a reactive agent, wherein the controller is configured to modify the appearance of the label, tag, package, or packaging material by transmitting an electronic control signal from the display driver to a number of the variable display elements, and wherein the electronic control signal is generated in response to a selected change in at least one of the environmental conditions of the environmentally-sensitive product, as sensed by the environmental sensor.

11. The system of claim 10, wherein the number of variable display elements comprise one or more display elements selected from the group including:

alphanumeric characters;

segments of alphanumeric characters;

dot matrix displays;

a barcode; and barcode characters.

* * * * *